US011976484B2

(12) United States Patent
Henson

(10) Patent No.: US 11,976,484 B2
(45) Date of Patent: May 7, 2024

(54) MODULAR DWELLING CONSTRUCTED FROM VERTICALLY ORIENTED INTERMODAL CONTAINERS

(71) Applicant: Cary James Henson, Jackson, TN (US)

(72) Inventor: Cary James Henson, Jackson, TN (US)

(73) Assignee: Cary James Henson, Jackson, TN (US)

( * ) Notice: Subject to any disclaimer, the term of this patent is extended or adjusted under 35 U.S.C. 154(b) by 133 days.

(21) Appl. No.: 17/698,477

(22) Filed: Mar. 18, 2022

(65) Prior Publication Data

US 2023/0295939 A1 Sep. 21, 2023

(51) Int. Cl.
*E04H 1/00* (2006.01)
*E04H 1/04* (2006.01)

(52) U.S. Cl.
CPC ..... *E04H 1/005* (2013.01); *E04H 1/04* (2013.01)

(58) Field of Classification Search
None
See application file for complete search history.

(56) References Cited

U.S. PATENT DOCUMENTS 4,221,515 A * 9/1980 Brown ..... B65D 88/022 206/505
8,950,158 B2 * 2/2015 Walton ..... H01Q 1/44 52/745.18
9,441,612 B2 * 9/2016 Haar ..... E04B 1/34336
9,605,659 B2 * 3/2017 Haar ..... E04B 1/34336
10,240,339 B1 * 3/2019 Dominguez ..... E04B 1/34869
11,276,323 B1 * 3/2022 Kirchner ..... G09B 9/00
11,613,887 B2 * 3/2023 Briggs ..... E04B 1/34807 52/79.1
2006/0230704 A1 * 10/2006 Lambreth ..... E04B 1/3442 52/745.02

(Continued)

FOREIGN PATENT DOCUMENTS

WO WO-2012113885 A1 * 8/2012 ..... B65D 88/12

OTHER PUBLICATIONS

Namma & Containers, Air Castle, webpage captured from https://www.nammacontainers.com/index.php/2022/04/07/air-castle/ on Jun. 2, 2022.

(Continued)

*Primary Examiner* — Joshua K Ihezie
(74) *Attorney, Agent, or Firm* — Bradley Arant Boult Cummings LLP; Phillip E. Walker; Lucas R. Yordy

(57) ABSTRACT

The present disclosure is directed to a modular dwelling constructed from intermodal containers. Particularly, the present disclosure is directed to a dwelling constructed from vertically oriented shipping containers. The dwelling may include a foundation and two or more intermodal containers disposed on and secured to the foundation. The intermodal containers may be separated by an interstitial space. The interstitial space may be fully or partially enclosed by a plurality of connector walls. Each intermodal container includes a top, a bottom, and four side walls One of the side walls may be a reinforced side wall. The reinforced side wall of one of the intermodal containers may extend parallel or perpendicular to one or more of the reinforced side walls of other intermodal containers. The dwelling may be divided into one or more rooms, floors, or apartments and may have doors, windows, appliances, a deck, or other common features.

18 Claims, 14 Drawing Sheets

(56) References Cited

U.S. PATENT DOCUMENTS

| | | | | |
|---|---|---|---|---|
| 2007/0084135 | A1* | 4/2007 | Ritter | E04B 1/3444 52/79.1 |
| 2008/0152468 | A1* | 6/2008 | de Milly | B65G 1/02 414/281 |
| 2011/0056147 | A1* | 3/2011 | Beaudet | E04B 1/34869 52/79.9 |
| 2014/0259978 | A1* | 9/2014 | Walton | H01Q 1/44 52/79.8 |
| 2014/0298745 | A1* | 10/2014 | Rechenmacher | E04H 1/005 52/425 |
| 2015/0244056 | A1* | 8/2015 | Walton | E04H 12/342 52/79.8 |
| 2015/0266616 | A1* | 9/2015 | Barrable | B65D 90/0006 403/267 |
| 2016/0130795 | A1* | 5/2016 | Downey | E04H 1/005 52/745.02 |
| 2016/0348651 | A1* | 12/2016 | Haar | H02S 10/12 |
| 2020/0240159 | A1* | 7/2020 | Grada | E04H 1/02 |
| 2020/0399889 | A1* | 12/2020 | Pospisil | E04B 1/7608 |
| 2021/0334425 | A1* | 10/2021 | Sharinn | E04H 1/005 |
| 2021/0372116 | A1* | 12/2021 | Hillenburg | E04B 1/34861 |
| 2022/0074194 | A1* | 3/2022 | Clark | E04H 1/12 |
| 2022/0144546 | A1* | 5/2022 | Tendo | G05D 1/02 |

OTHER PUBLICATIONS realestate.com.au, Tom Bowden, Adelaide CBD's smallest allotment turned into impressive skinny container house, published on Mar. 4, 2019, webpage captured from https://www.realestate.com.au/news/adelaide-cbds-smallest-allotment-turned-into-impressive-skinny-container-house/ on Jun. 2, 2022.

Off Grid World, Shipping Container Home Designs, published on Apr. 24, 2021, webpage captured from https://offgridworld.com/shipping-container-home-designs/ on Jun. 2, 2022.

Living in a Container, Fabulous Container House in Winsconsin [sic] by Factotum Fabricor, published on Jul. 24, 2020, webpage captured from https://www.livinginacontainer.com/fabulous-container-house-in-winsconsin-by-factotum-fabricor/ on Jun. 2, 2022.

Living in Container, 5 Vertical Shipping Container Home Designs, published on May 5, 2015, webpage captured from http://liveincontainer.com/5-vertical-shipping-container-home-designs/ on Jun. 2, 2022.

Jetson Green, Jetson Green, Cross Shaped Shipping Container Home, published on Aug. 2, 2014, webpage captured from https://www.jetsongreen.com/2014/08/cross-shaped-shipping-container-home.html on Jun. 2, 2022.

Inhabitat, Shipping Container-Inspired Homebox is a Tiny, Movable 3-Story Vertical Home, published on Oct. 18, 2012, webpage captured from https://inhabitat.com/shipping-container-inspired-homebox-is-a-tiny-movable-3-story-vertical-home/homebox-han-slawik-7/ on Jun. 2, 2022.

Pinterest, Katie David, Granary Row Shipping Container Neighborhood in Salt Lake City, webpage captured from https://www.pinterest.co.uk/pin/425519864772858654/ on Jun. 2, 2022.

Archdaily, Karissa Rosenfield, GA Designs Radical Shipping Container Skyscraper for Mumbai Slum, webpage captured from https://www.archdaily.com/772414/ga-designs-radical-shipping-container-skyscraper-for-mumbai-slum on Jun. 2, 2022.

Downtown Container Park, Downtown Container Park, webpage captured from https://downtowncontainerpark.com/ on Jun. 2, 2022.

* cited by examiner

MODULAR DWELLING CONSTRUCTED FROM VERTICALLY ORIENTED INTERMODAL CONTAINERS

This is a Non-Provisional Patent Application filed by inventor Cary James Henson, a citizen of the United States, residing in Jackson, Tennessee, for the new and useful invention of a "Modular Dwelling Constructed from Vertically Oriented Intermodal Containers."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety

FIELD OF INVENTION

The invention concerns modular dwellings constructed from intermodal containers. Specifically, the invention is directed toward dwellings constructed from vertically oriented intermodal containers.

BACKGROUND

The present disclosure is directed at a modular dwelling constructed from vertically oriented intermodal containers. Intermodal containers are large, standardized containers designed for intermodal freight transport to allow cargo to be moved between different modes of transportation, such as plane, ship, train, and truck, without unloading and reloading cargo into different containers. Intermodal containers may also be known as shipping containers, cargo containers, freight contains, ISO containers, sea containers, ocean containers, or by numerous other terms known in the shipping and transportation industry. Intermodal containers come in a number of standardized sizes and are typically used in a horizontal orientation where the length of the containers is greater than the height and width of the containers.

It is estimated that there are over 20 million intermodal containers across the globe. Of those 20 million or more intermodal containers in existence, less than 10 million intermodal containers are actively used for shipping and transportation. The remaining intermodal containers often go unused for any other purpose. Many intermodal containers may only be used once before being disposed of or placed into storage as it is often cheaper to manufacture intermodal containers than it is to transport intermodal containers to be reused. Though intermodal containers contain several thousand pounds of metal, it is costly and energy intensive to melt down the containers to recycle the metal. Because intermodal containers are continually produced but often not reused or recycled, there is a surplus of intermodal containers globally.

One option for reducing the surplus of intermodal containers is to repurpose the intermodal containers for other uses. Intermodals containers are frequently repurposed as buildings for storage, living, or retail space. Repurposed intermodal containers are frequently used in a horizontal orientation. As a result, the design or layout of buildings constructed from repurposed intermodal containers is limited by the shape of intermodal containers in the horizontal orientation.

Therefore, there is a need for a modular dwelling constructed from vertically oriented intermodal containers that allows far more freedom in the layout or design of the dwelling.

BRIEF SUMMARY OF THE INVENTION

Figure 1:
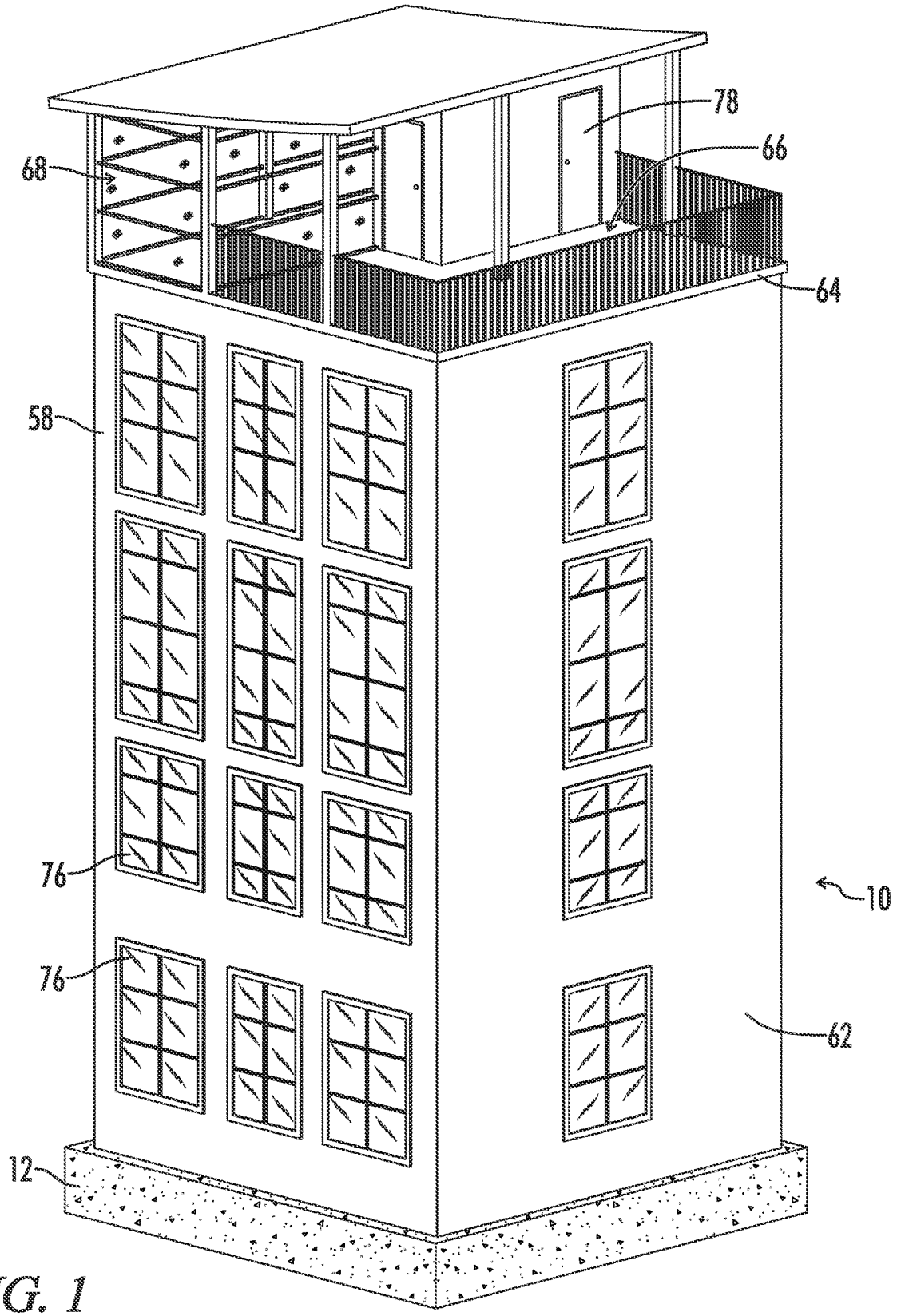
FIG. 1 is a perspective view of a modular dwelling made in accordance with the current disclosure.
Figure 2:
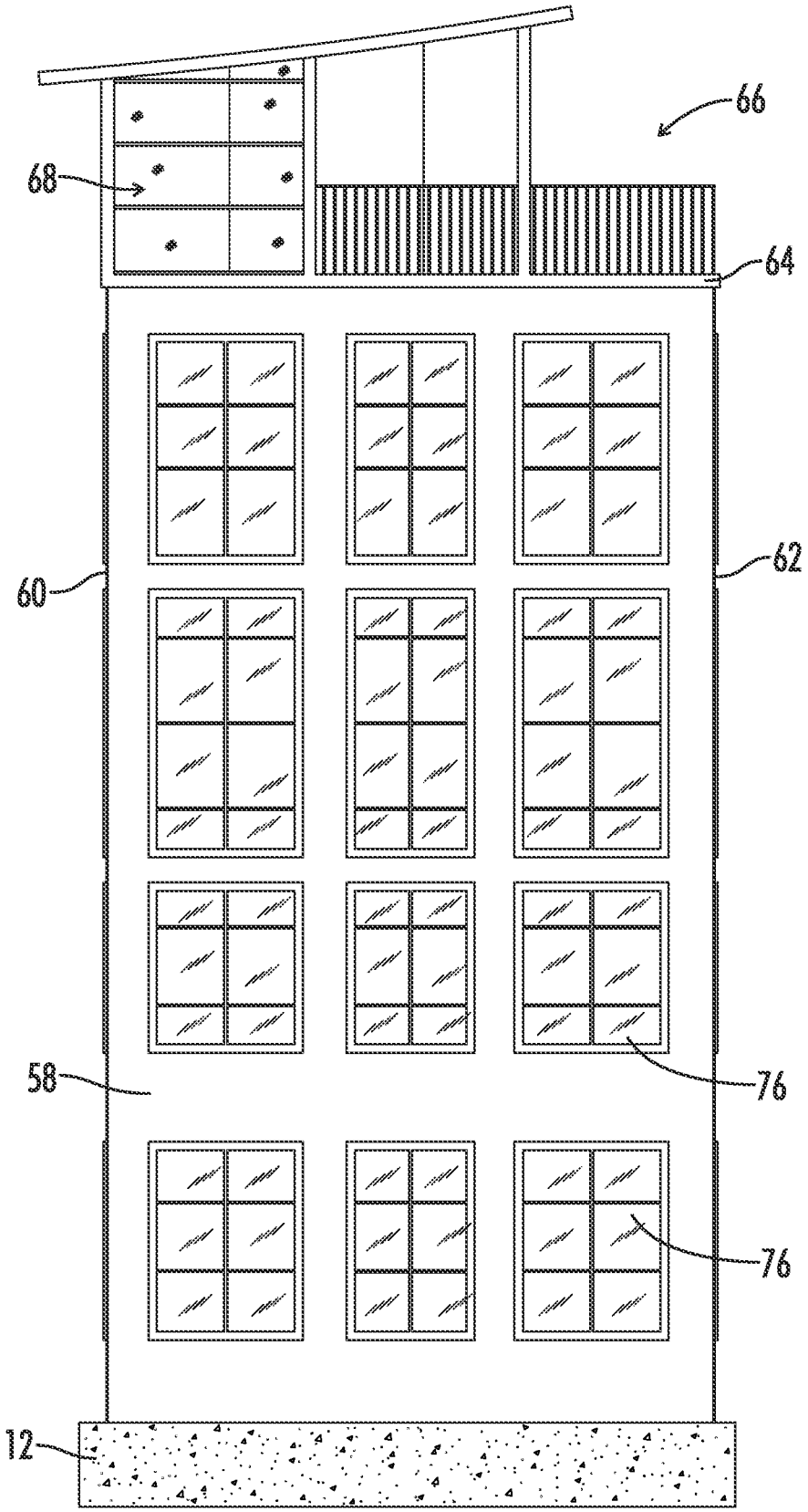
FIG. 2 is an elevation view of the modular dwelling of FIG. 1.
Figure 3:
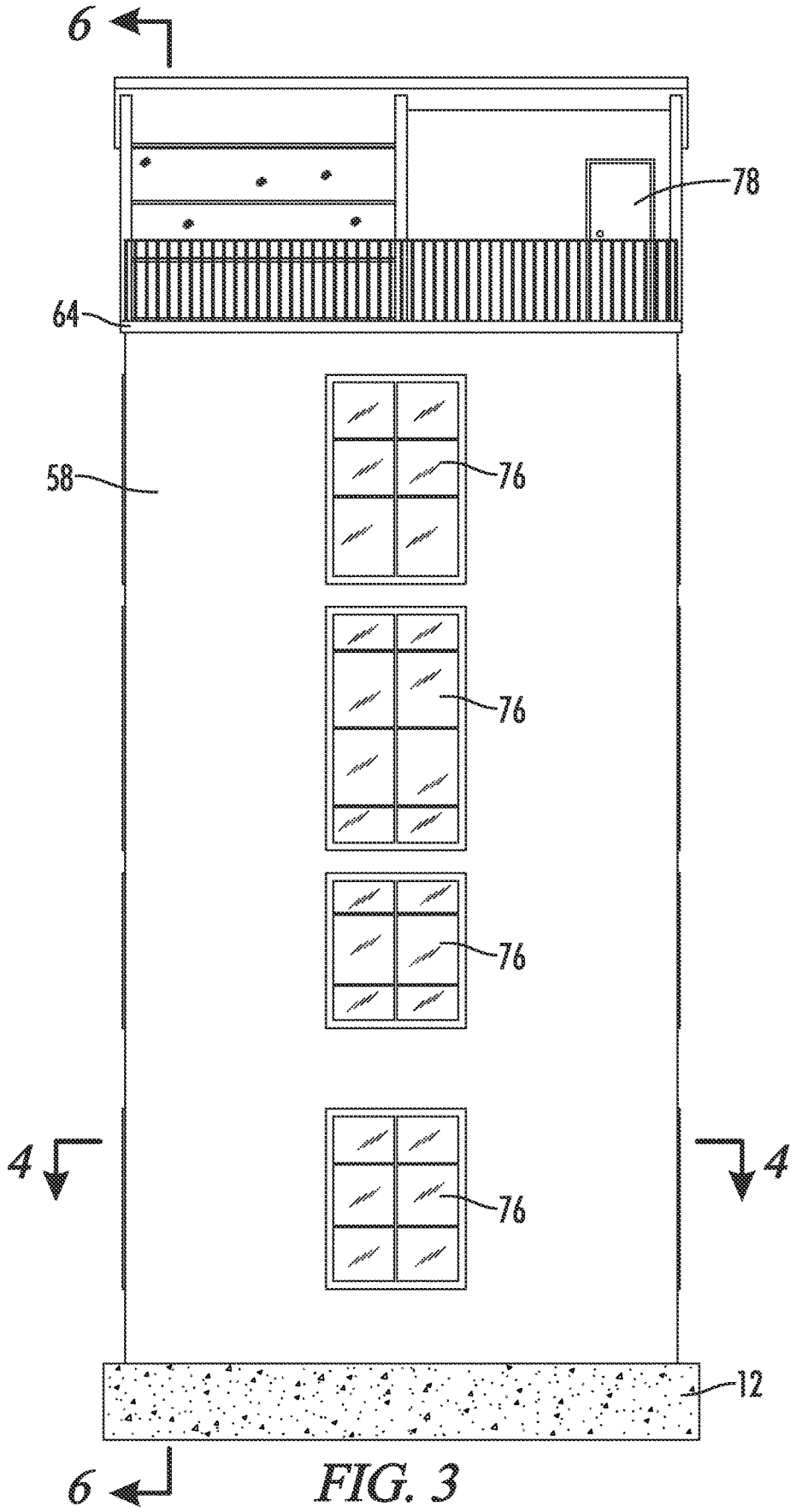
FIG. 3 is another elevation view of the modular dwelling of FIG. 1.

Disclosed herein is a dwelling constructed from vertically oriented shipping containers. The dwelling is designed to be modular and to be easily and quickly constructed from readily available materials. The design of the dwelling also allows for increased usable living space and enhanced structural integrity of the dwelling. The preferred dwelling constructed from vertically oriented shipping containers overcomes the disadvantages associated with the prior art and includes other advantages over the current art.

In an embodiment, the dwelling can include a foundation and two or more intermodal containers disposed on and secured to the foundation. A plurality of anchors can be embedded in the foundation. Preferably, each intermodal container is secured to at least one anchor and is electrically grounded. In some embodiments, the dwelling can comprise four intermodal containers.

Each intermodal container may comprise a top, a bottom, a height extending vertically from the top to the bottom, a first side wall, a second side wall opposite the first side wall, a length extending horizontally from the first side wall to the second side wall and perpendicular to the height, a third side wall, a fourth side wall opposite the third side wall, a width extending horizontally from the third side wall to the fourth side wall and perpendicular to the height and length, and/or an open interior. Preferably, the height of each intermodal container is greater than the length and width of each intermodal container.

In some embodiments, one of the first side wall, second side wall, third side wall, and fourth side wall of each intermodal container is a reinforced side wall. The reinforced side wall may have a substantially flat interior surface adjacent the open interior of the intermodal container and a substantially flat exterior surface opposite the interior surface. A plurality of horizontal cross beams can be disposed on the exterior surface of the reinforced side wall of each intermodal container. A plurality of cavities may be formed by and disposed between the plurality of horizontal cross beams on each intermodal container. Insulation can be disposed within the plurality of cavities.

The intermodal containers may be oriented so that at least two of the reinforced side walls are substantially coplanar. Optionally, the reinforced side wall of one of the intermodal containers extends perpendicular to the reinforced side wall of at least one other intermodal container. In further embodiments, the reinforced side wall of each intermodal container can be substantially coplanar with the reinforced side wall of at least one other intermodal container.

The dwelling may also include an interstitial space and a plurality of connector walls. The interstitial space may extend between and separate the intermodal containers. The plurality of connector walls may extend between the intermodal containers and at least partially enclose the interstitial space. The intermodal containers and plurality of connector walls can be disposed such that the dwelling has a substantially rectangular horizontal plane profile.

Each intermodal container preferably includes one or more openings in at least one side wall. The openings may connect the open interiors of the intermodal containers to the interstitial space. The openings may cover greater than 75% of one or more of the side walls of one or more the intermodal containers. Preferably, each intermodal container has openings in two of the side walls.

The dwelling may have a perimeter and an exterior wall extending about the perimeter. The exterior wall may be formed from the plurality of connector walls and one or more side walls of each intermodal container. The exterior wall may have a first side and a second side opposite the first side. In some embodiments, the reinforced side walls of two intermodal containers can be disposed adjacent the exterior wall first side, and the reinforced side walls of two other intermodal containers can be disposed adjacent to the exterior wall second side.

The dwelling may include any combination of numerous features commonly found in conventional dwellings. The dwelling may have at least one doorway or window in the exterior wall. The dwelling may be divided into two or more stories. A staircase or elevator can be disposed within the dwelling. A roof can be disposed above the intermodal containers and the interstitial space. A deck or patio can be disposed on the roof.

Other and further objects, features and advantages of the present invention will be readily apparent to those skilled in the art upon reading of the following disclosure when taken in conjunction with the accompanying drawings.

DETAILED DESCRIPTION

Referring now to FIGS. 1-14, one embodiment of the present disclosure provides a modular dwelling constructed from vertically oriented intermodal containers. It is understood that, for the sake of clarity, not all reference numbers are included in each drawing. In addition, positional terms such as a "upper," "lower," "side," "top," "bottom," "vertical," "horizontal," etc. refer to the parts of components when in the orientation shown in the drawings.

Figure 4:
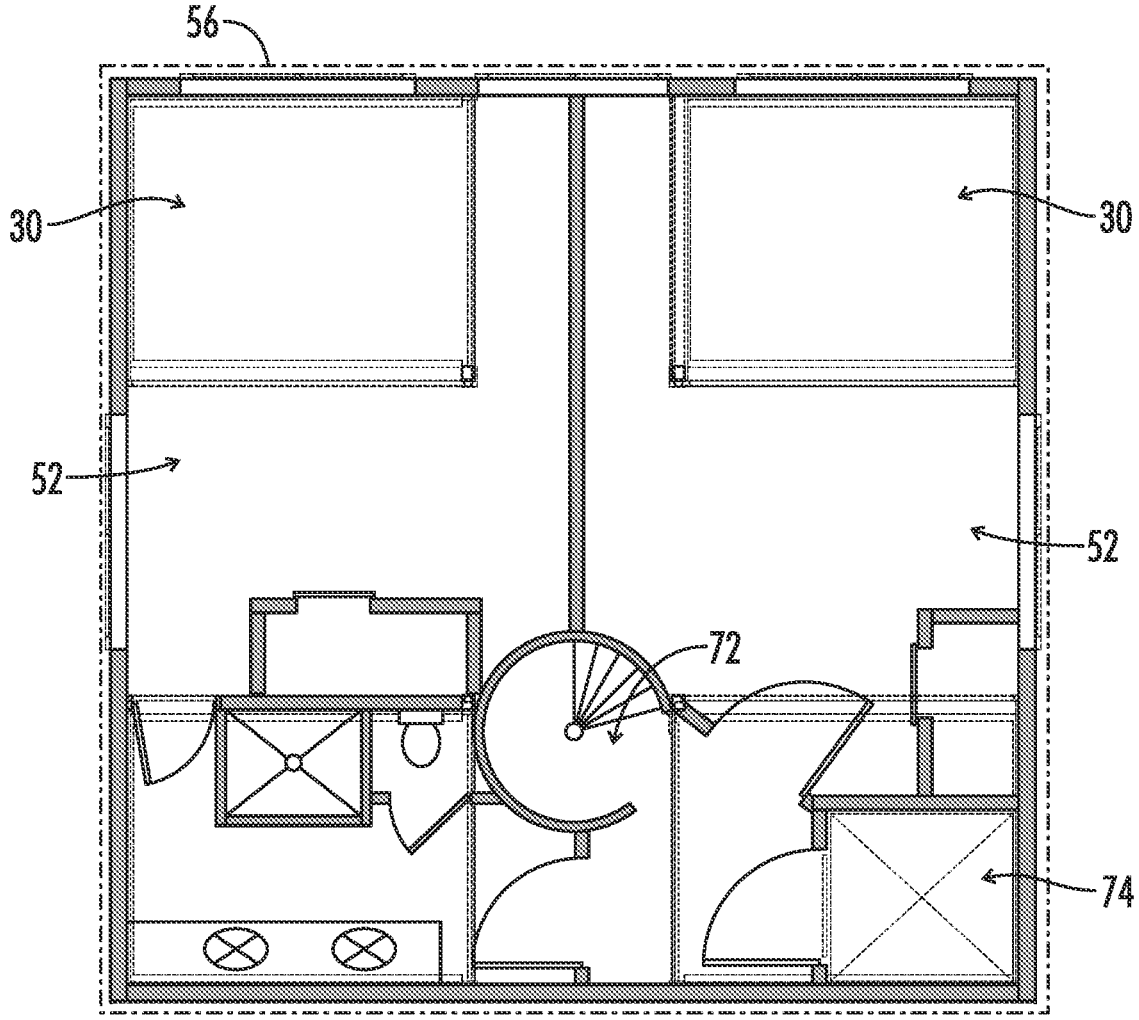
FIG. 4 is a cross-sectional plan view of the modular dwelling of FIG. 1.
Figure 5:
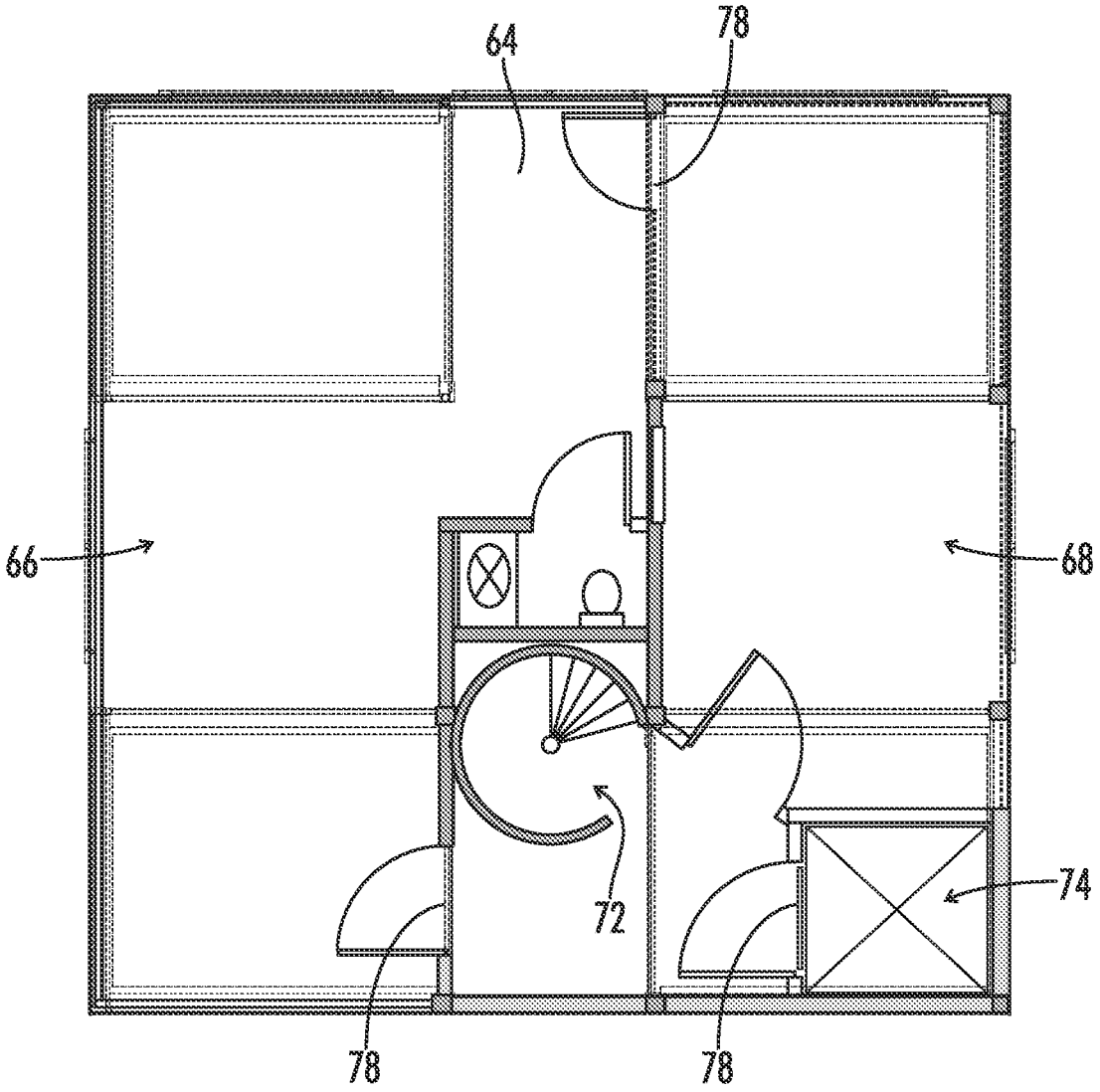
FIG. 5 is a top, plan view of the roof of the modular dwelling of FIG. 1.
Figure 6:
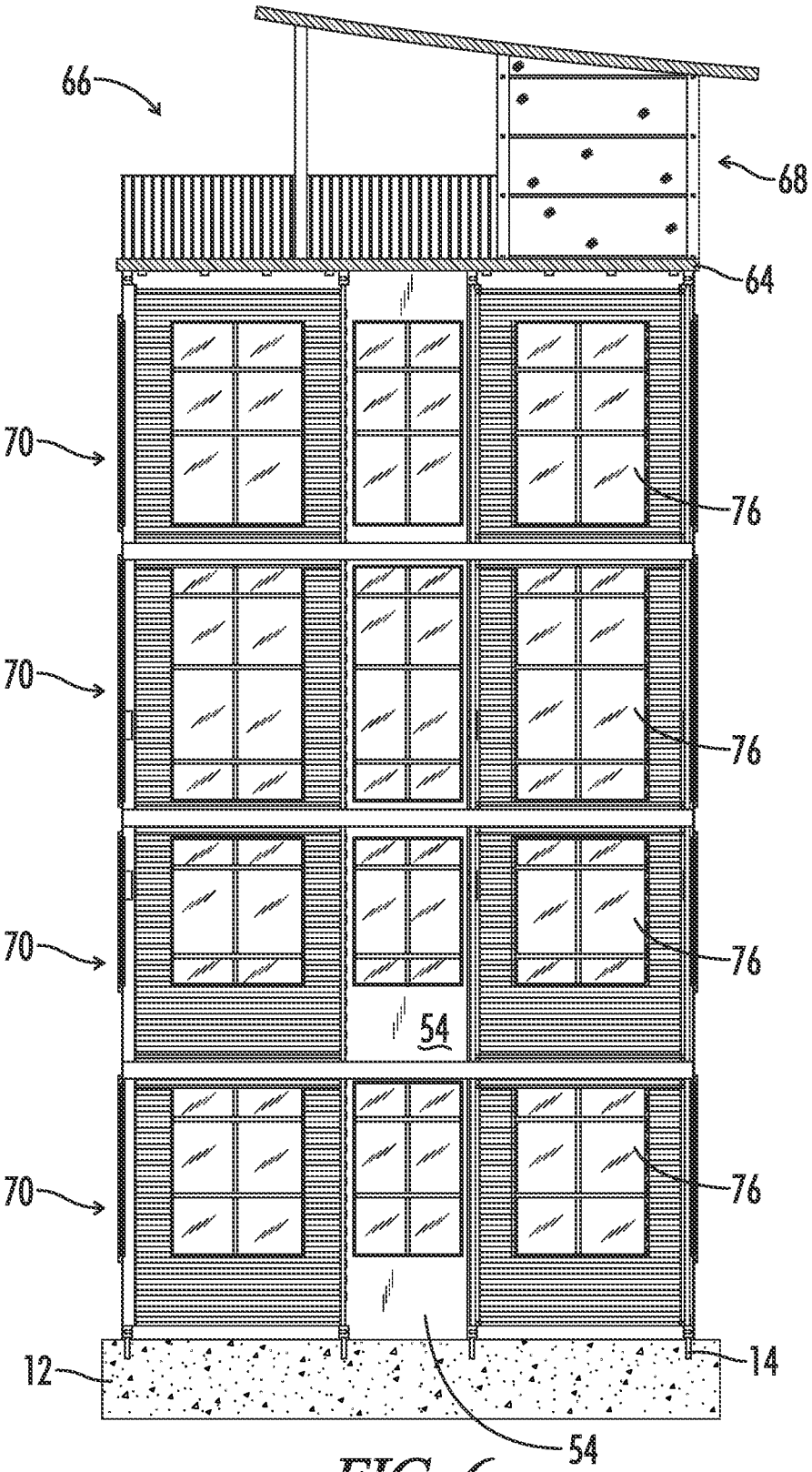
FIG. 6 is a cross-sectional, elevation view of the modular dwelling of FIG. 1.

The dwelling is shown and generally designated by the numeral 10. FIGS. 1-6 depict one embodiment of the dwelling. The dwelling 10 may comprise a foundation 12 to support the dwelling 10. The foundation 12 can be disposed above, below, or level with the ground. The foundation 12 may be constructed from concrete, rock, or other suitable material known to those in the art for constructing foundations for dwellings. As best shown in FIG. 6, a plurality of anchors 14 can be embedded in the foundation 12 to secure the foundation to other components of the dwelling as discussed below.

The dwelling 10 further comprises intermodal containers 16 to provide structural support to the dwelling 10. The intermodal containers 16 can be any number of containers designed for use across different modes of transportation, such as plane ship, train, and truck, without the need to unload and reload cargo when switching between modes of transportation. When used for shipping and transportation, intermodal containers 16 are used in a horizontal orientation where the length of the intermodal container 16 is greater than the height or width of the intermodal container 16. As discussed below, the present disclosure uses intermodal containers 16 in a vertical orientation wherein the height is greater than the length and width.

FIGS. 7-10 depict one embodiment of the dwelling 10 in a partially constructed state with the intermodal containers 16 exposed. The intermodal containers 16 can be disposed on and secured to the foundation 12 to form the living space of the dwelling 10. Preferably, the dwelling 10 comprises at least two intermodal containers 16. The dwelling 10 may comprise four or more intermodal containers 16. Each intermodal container 16 may be secured to at least one anchor 14 embedded in the foundation 12 to secure the intermodal containers 16 to the foundation 12. Preferably, each intermodal container 16 is secured to four or more anchors 14.

As best shown in FIGS. 7-10, each intermodal container 16 can comprise a top 18, a bottom 20, a first side wall 22, a second side wall 24 opposite the first side wall 22, a third side wall 26, and a fourth side wall 28 opposite the third side wall 26, and an open interior 30. The side walls 22, 24, 26, 28 may be constructed from corrugated metal. The side walls 22, 24, 26, 28 of each intermodal container 16 are connected at corner joints 32. Unless otherwise stated herein, the terms "first side wall" 22, "second side wall" 24, "third side wall" 26, and "fourth side wall" 28, do not refer to a particular side wall of each intermodal container 16. Rather, the designations are used to indicate that each intermodal container 16 has four different side walls 22, 24, 26, 28.

Additionally, each intermodal container 16 may have a height 34 extending vertically from the top 18 to the bottom 20, a length 36 extending from the first side wall 22 to the second side wall 24, and a width 38 extending between the third side wall 26 and the fourth side wall 28. For each intermodal container 16, the height 34 may extend perpendicular to the length 36, and the width 38 may extend perpendicular to the height 34 and the length 36. The height 34 of each intermodal container 16 may be greater than the length 36 and the width 38 of each intermodal container 16. The length 36 of each intermodal container 16 may be greater than, less than, or equal to the width 38.

As used herein, an intermodal container 16 is vertically oriented when the height 32 of each intermodal container 16 is greater than the length 34 and the width 36 as shown in FIGS. 7-10. In contrast, an intermodal container 16 is horizontally oriented when the height 32 of each intermodal container 16 is less than the length 34 or width 36 of the intermodal container 16. Unless otherwise specified, references to an intermodal container 16 as used herein refer to an intermodal container 16 in a vertical orientation.

The first side wall 22, second side wall 24, third side wall, 26, and fourth side wall 28 of a vertically oriented intermodal container 16 may be the same walls that would be referred to as the top wall, bottom wall, or side walls of a horizontally oriented intermodal container 16. Further, the top 18 or bottom 20 of a vertically oriented intermodal container 16 may be the same sides that would be referred to as the front or rear end of a horizontally oriented intermodal container 16. The front end of a horizontally oriented intermodal container 16 may be the end of the container having doors. The rear end of a horizontally oriented intermodal container 16 may be the end of the horizontally oriented container opposite the front end. Preferably, the top 18 of a vertically oriented intermodal container 16 may be the same side that would be referred to as the front end of a horizontally oriented intermodal container 16, and the bottom 20 of a vertically oriented intermodal container 16 may be the same side that would be referred to as the rear end of a horizontally oriented intermodal container 16.

Figure 7:
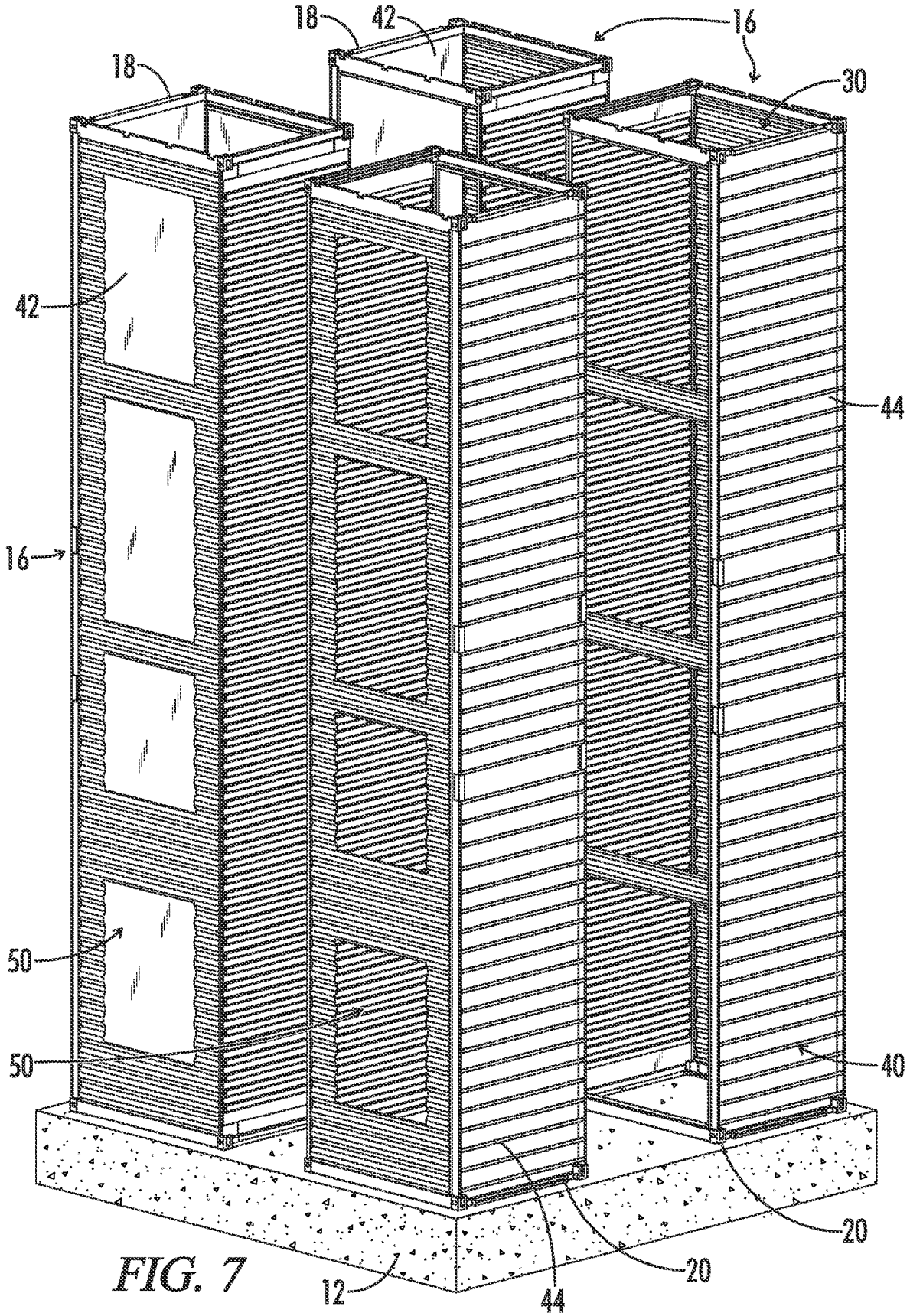
FIG. 7 is a perspective view of a modular dwelling in a partially constructed state in accordance with the present disclosure.
Figure 10:
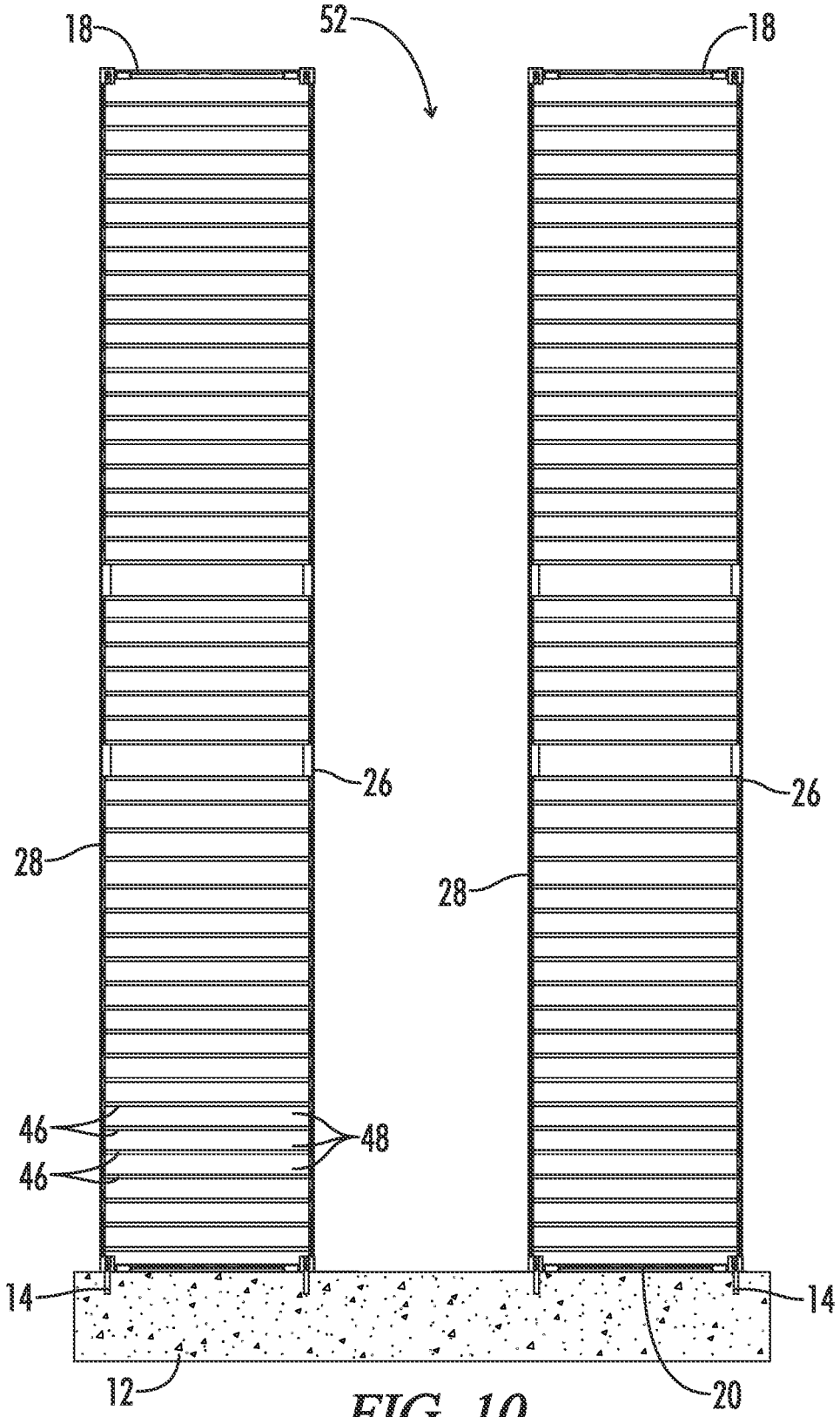
FIG. 10 is another elevation view of the modular dwelling of FIG. 7.
Figure 11:
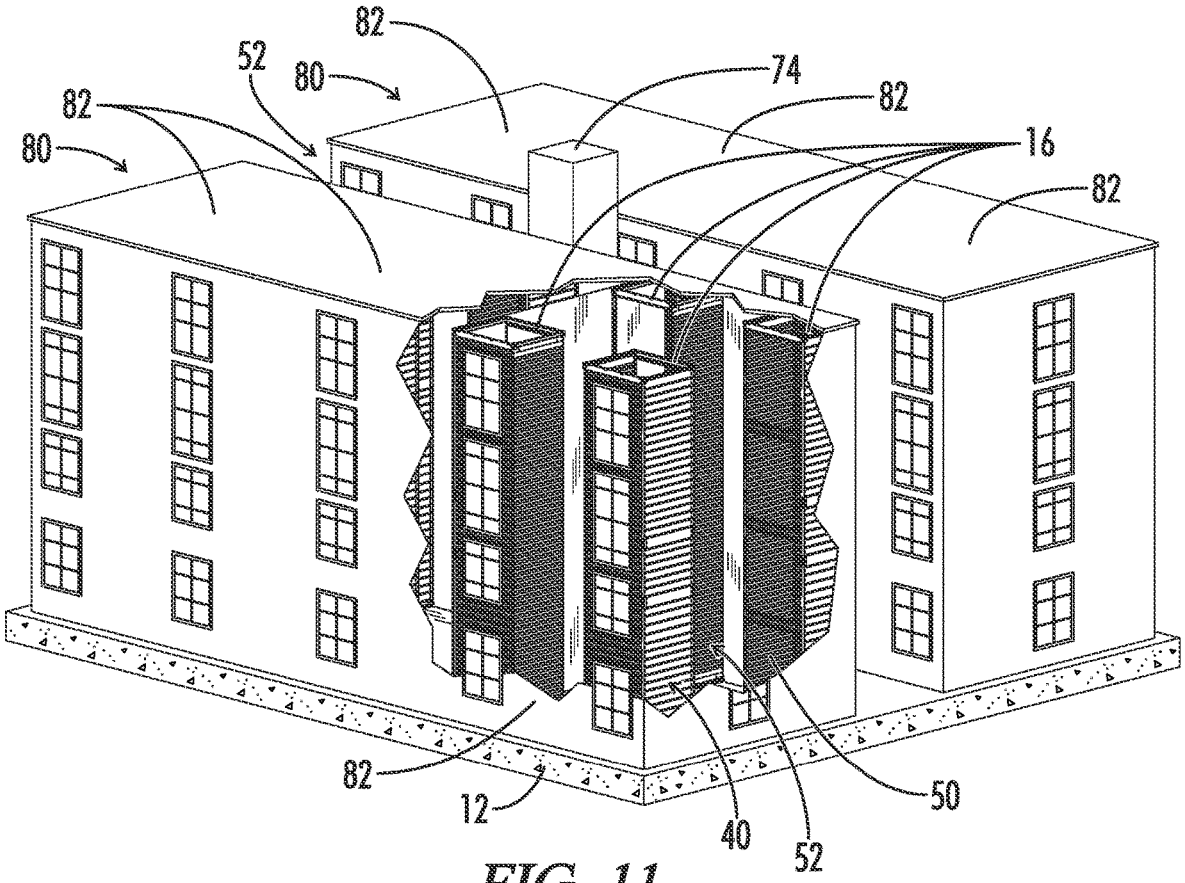
FIG. 11 is a perspective sectional view of a multifamily embodiment of a modular dwelling made in accordance with the present disclosure.
Figure 12:
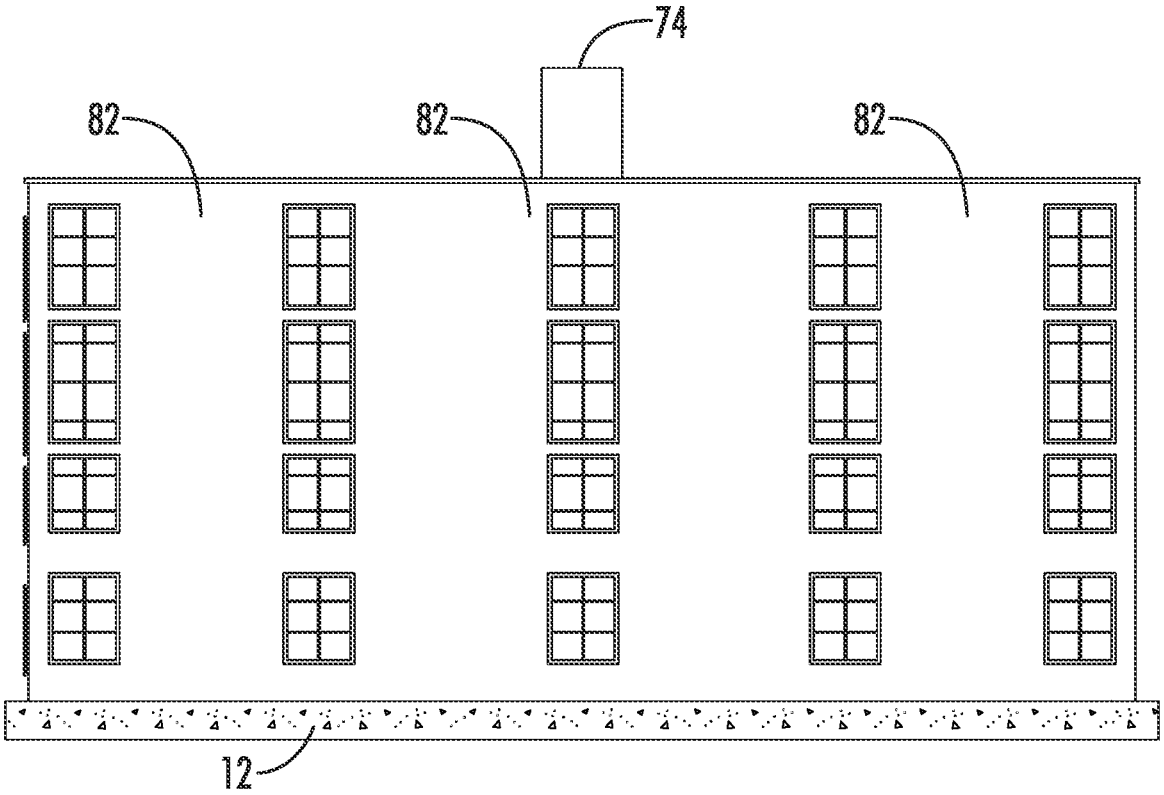
FIG. 12 is an elevation view of the modular dwelling of FIG. 11.
Figure 13:
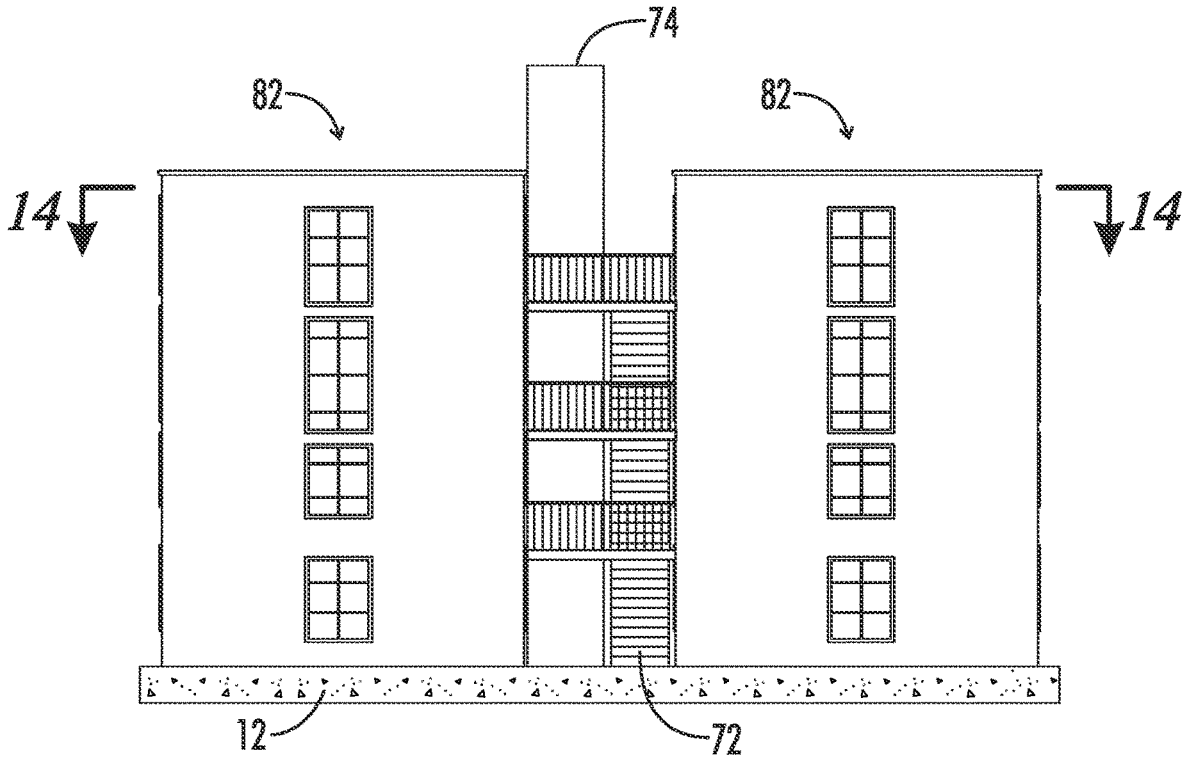
FIG. 13 is another elevation view of the modular dwelling of FIG. 11.

In some embodiments, one of the first side wall 22, second side wall 24, third side wall 26, and fourth side wall 28 may be a reinforced side wall 40 for providing enhanced structural support to the dwelling 10 as best shown in FIGS. 7 and 10. Generally, the reinforced side wall 40 of an intermodal container 16 in a vertical orientation may be the same wall as the bottom wall or floor of an intermodal container 16 in a horizontal orientation. The reinforced side wall 40 may be constructed from a thicker or stronger material than the remaining side walls 22, 24, 26, 28. The reinforced side wall 40 may have a substantially flat interior surface 42 adjacent the open interior 30 and a substantially flat exterior surface 44 opposite the interior surface 42. In contrast, the other side walls 22, 24, 26, 28 may be corrugated and not substantially flat.

As shown in FIG. 10, each intermodal container 16 may further comprise a plurality of horizontal cross beams 46 disposed on and extending horizontally across the exterior surface 44 of the reinforced side wall 40 to further strengthen the reinforced side wall 40. The horizontal cross beams 46 can be spaced apart from each other to form a plurality of cavities 48 disposed between the plurality of horizontal cross beams 46. During construction of the dwelling 10, insulation can be disposed in the plurality of cavities 48.

Figure 8:
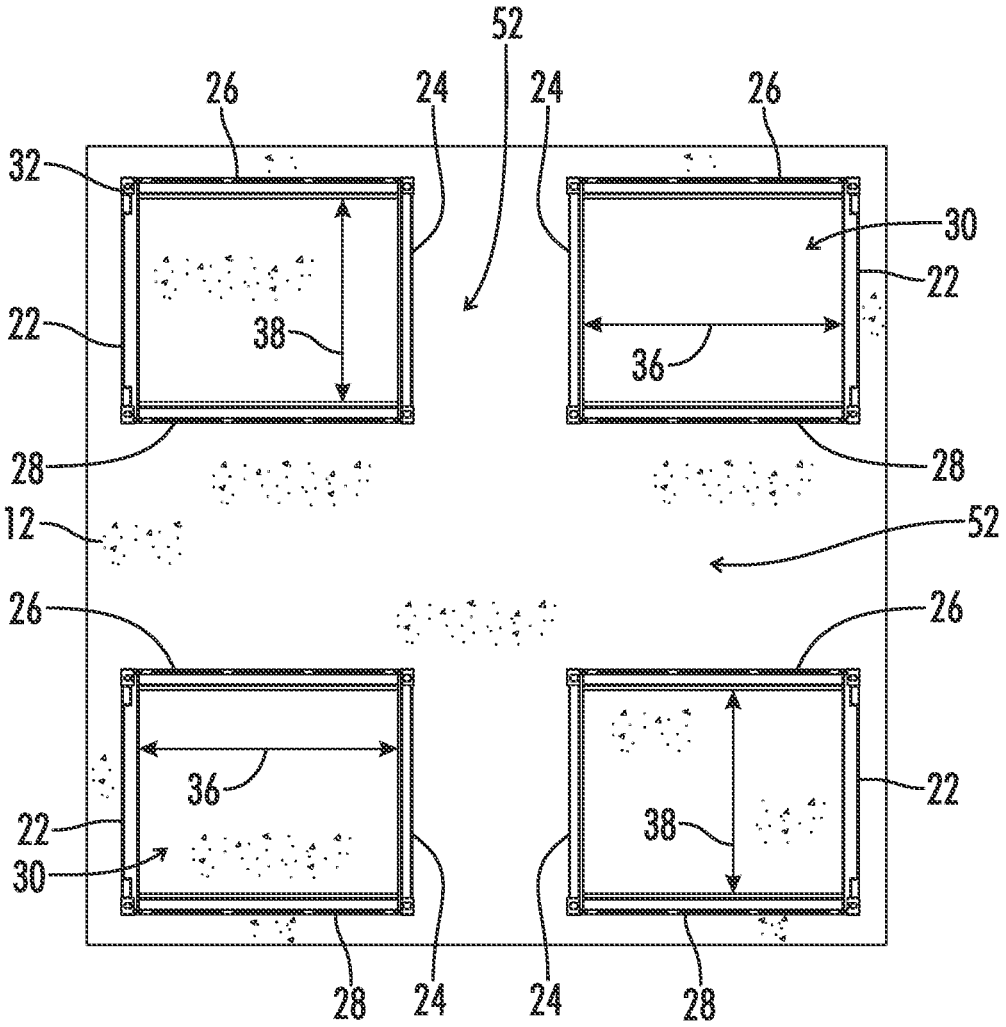
FIG. 8 is a top plan view of one side of the modular dwelling of FIG. 7.
Figure 9:
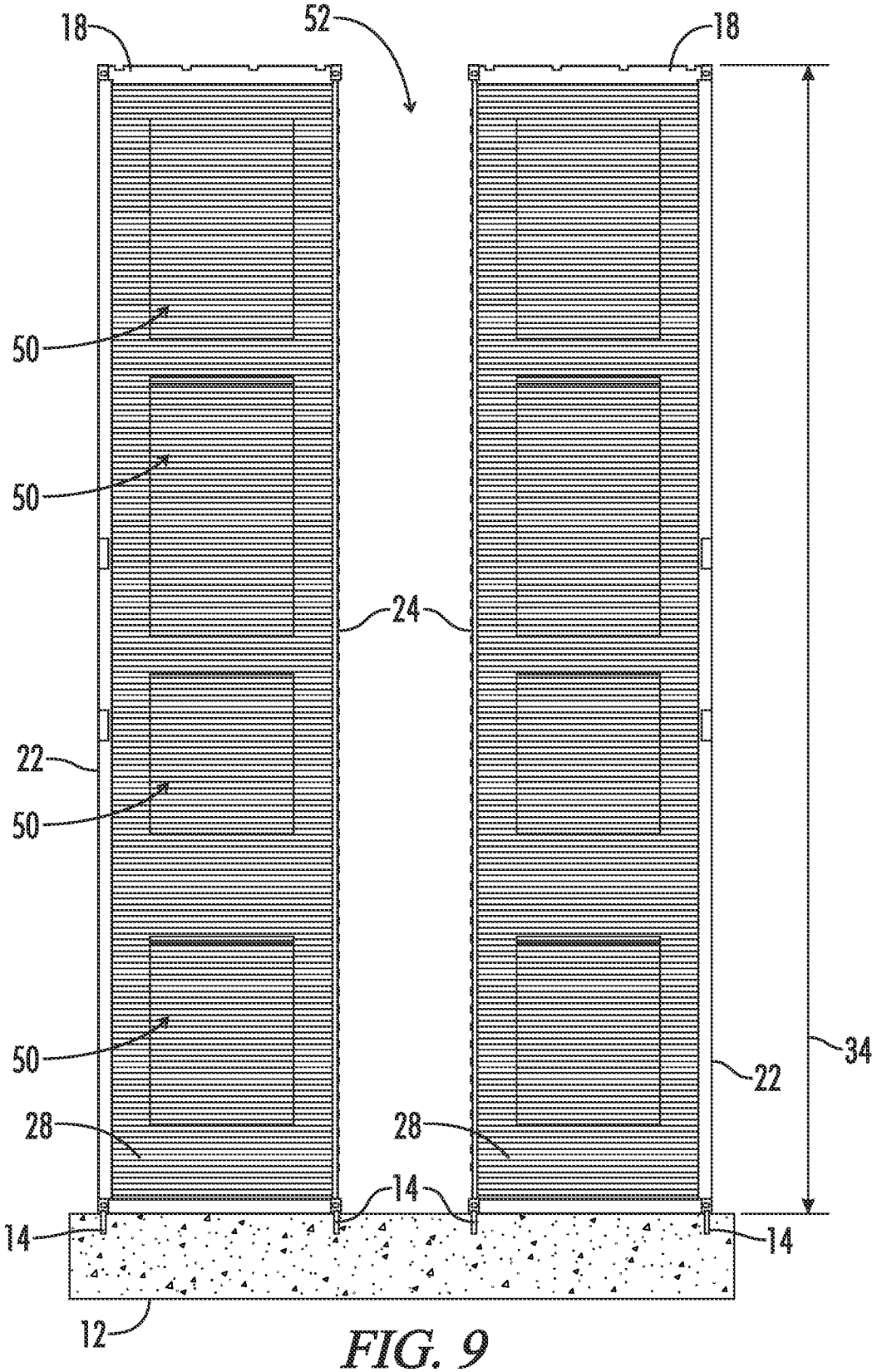
FIG. 9 is an elevation view of the modular dwelling of FIG. 7.

Depending on the desired appearance and structural characteristics of the dwelling 10, the intermodal containers 16 may be oriented to arrange the reinforced side walls 40 in a particular pattern. As shown in FIG. 8, the intermodal containers may be oriented such that two or more of the reinforced side walls are substantially coplanar. In some cases, one or more reinforced side walls 40 may extend substantially perpendicular to one or more reinforced side walls 40 on other intermodal containers 16. In other cases, the reinforced side wall 40 on each intermodal container 16 can be substantially coplanar to the reinforced side wall 40 of at least one other intermodal container 16.

Each dwelling 16 can include one or more openings 50 in one or more of the side walls 22, 24, 26, 28 of each intermodal container 16 to allow inhabitants to move into and out of the open interior 30. In some cases, each intermodal container may have openings in two, three, or four of the side walls 22, 24, 26, 28. In embodiments with a reinforced side wall 40, the reinforced side wall 40 may be free of openings 50. The openings can be disposed on a side wall 22 adjacent to an exterior wall 58 or the interstitial space 52 of the dwelling 10, discussed below. In some cases, the openings may cover over 75% of the surface area of one or more of the side walls 22, 24, 26, 28.

As depicted in FIGS. 7-8, the dwelling 10 may comprise an interstitial space 52 for separating the intermodal containers 16 from each other. The interstitial space 52 can be disposed above the foundation 12 and extend between the intermodal containers 16. In embodiments having two intermodal containers 16, the interstitial space 52 may have a rectangular horizontal-plane profile. In embodiments having four intermodal containers 16, the interstitial space 52 may have a cross-shaped horizontal-plane profile. The openings 50 allow inhabitants to move between the interstitial space 52 and the open interiors 30 of the intermodal containers 16. Among other advantages, the interstitial space 50 increases the amount of livable space in the dwelling 10 without requiring additional intermodal containers 16.

Further, the dwelling 10 may comprise a plurality of connector walls 54 for connecting the intermodal containers 16 and enclosing the interstitial space 52. The connector walls 54 can be disposed between and connect the intermodal containers 16 together. The connector walls 54, together with the intermodal containers 16, may partially or fully enclose the interstitial space 52. In some embodiments, the intermodal containers 16, interstitial space 52, and/or plurality of connector walls 54 may be arranged such that the dwelling 10 has a substantially rectangular horizontal plane profile. The connector walls 54 may be constructed from standard building materials such as wood, sheetrock, or similar materials known in the industry.

The dwelling 16 can include a perimeter 56 and an exterior wall 58 extending about the perimeter 56. The exterior wall 58 can be integrally formed from the plurality of connector walls 54 and one or more of the side walls 22, 24, 26, 28 of each intermodal container 16. The exterior wall 58 can includes a first side 60 and a second side 62 opposite the first side 60. In some embodiments having four or more intermodal containers 16, the reinforced side walls 40 of two intermodal containers 16 can be disposed adjacent to the exterior wall first side, and the reinforced side walls 40 of two other intermodal containers 16 can be disposed adjacent to the exterior wall second side 62. In other embodiments, the reinforced side wall 40 of at least one intermodal container 16 can be disposed adjacent to each side of the exterior wall 58.

The dwelling 10 may further comprise a roof 64 to provide cover for the dwelling 10. FIG. 5 depicts a plan view of one embodiment of the dwelling 16 with a roof 64. The roof 64 may be constructed from metal, wood, concrete, shingles, or other roofing materials commonly known and used in the art. In some embodiments, the dwelling 10 further comprises a deck 66 or patio 68 on top of the roof 64 as shown in FIG. 5. Concrete may be poured onto the tops 18 of the intermodal containers 16 and above the interstitial space 52 to form the floor of the deck 66 or patio 68. The deck 66 can be open with no covering. The patio 68 can be covered and can be enclosed or screened in.

FIG. 6 depicts a cross-sectional elevation view of the dwelling 10 with the interstitial space 52 and open interiors 30 of the intermodal containers 16 exposed. As best shown in FIG. 6, the dwelling 10 can be divided internally into two or more stories 70 to provide more livable area within the dwelling 10. The number of stories 70 within the dwelling 10 may depend on the height 34 of the intermodal containers 16 used. Each story 70 may extend continuously throughout the interstitial space 52 and the open interior 30 of each intermodal container 16. Each story can be divided into one or more rooms as best shown in FIG. 4. The rooms may be defined by the side walls 22, 24, 26, 28 of the intermodal containers 16, the connector walls 54, or other internal walls.

As shown in FIGS. 4 and 5, the dwelling 10 may also comprise a staircase 72 and/or an elevator 74 to allow inhabitants to move between stories 70. The stairs 72 or elevator 74 can be disposed within the open interior 30 of one of the intermodal containers 16 or within the interstitial space 52. The staircase 72 can be a spiral staircase or other style of staircase known and used in the industry.

The dwelling 10 may also comprise one or more windows 76 or doorways 78 as shown in FIGS. 1-6. The windows 76 or doorways 78 may be disposed in one of the openings 50 in the side walls 22,24,26,28 of the intermodal containers 16 or in the connector walls 54. The doorways 78 can be internal doorways that allow inhabitants to move between rooms, the interstitial space 54, and the open interiors 30 of the intermodal containers 16.

The dwelling 10 can also include several other fixtures commonly found in dwellings. The dwelling 10 may be fitted with plumbing, an electrical system, and heating and air conditioning. The dwelling 10 may include fixtures and appliances, such as light fixtures, sinks, showers, baths, toilets, stoves, refrigerators, dish washers, and other desired fixtures and appliances. In some embodiments, the dwelling 10 may be integrated with an existing dwelling or structure.

As shown in FIGS. 11-14, in some embodiments, the dwelling 10 can be a multifamily dwelling 10. In such cases, the dwelling 10 may comprise up to 20 or more intermodal containers 16 each separated from the other intermodal containers 16 by an interstitial space 52. The dwelling 10 may be divided into one or more towers 80. Each tower 80 may comprise up to ten or more intermodal containers 16. Each tower 80 may be equal in size. The towers 80 can be separated by an interstitial space 52 that can be enclosed or open. A staircase 72 and/or an elevator 74 may be disposed in the interstitial space 16 separating the towers 80 to allow access to all stories 70 of each tower 80 by means of a single staircase 72 and/or single elevator 74.

Figure 14:
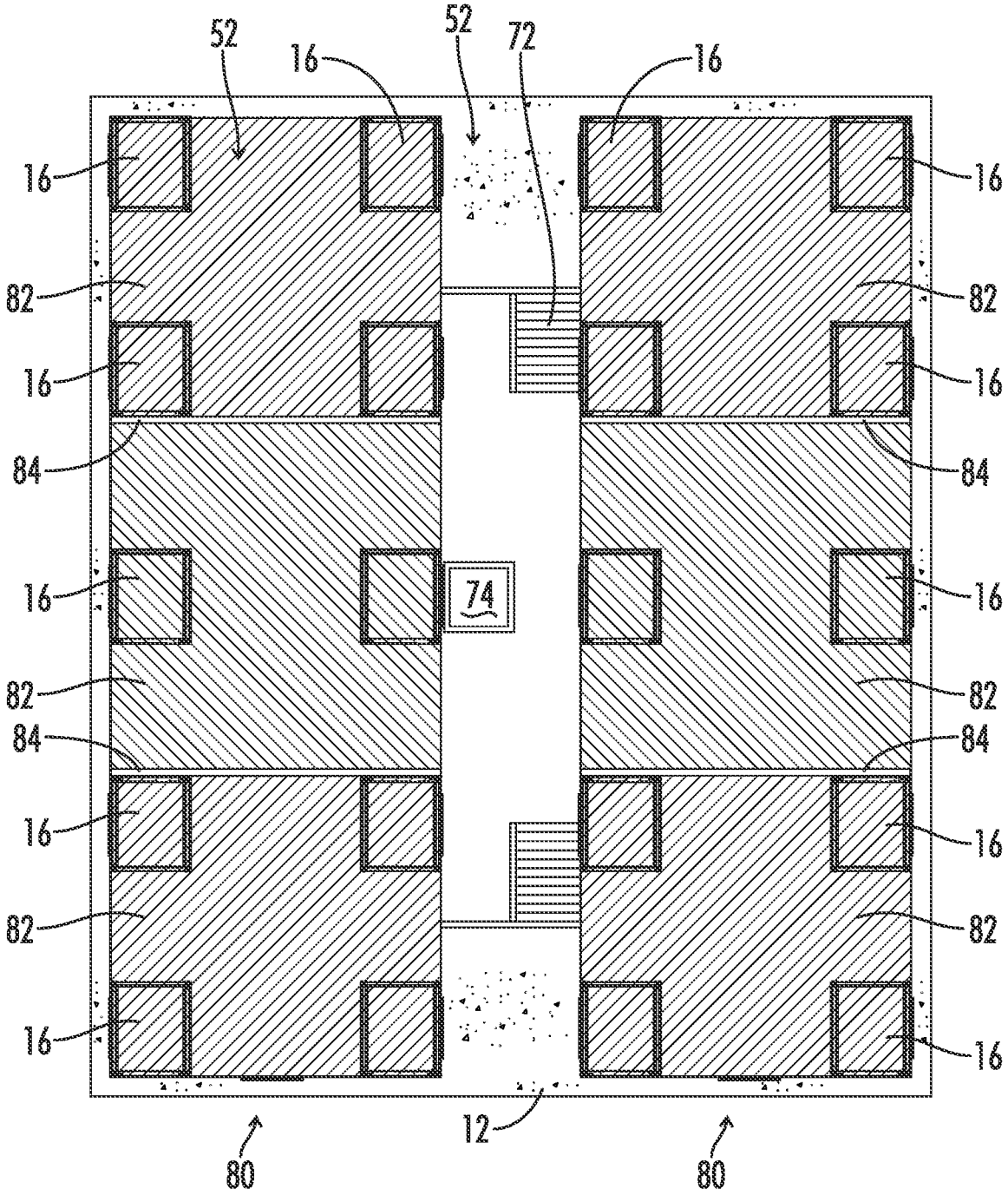
FIG. 14 is a cross-sectional plan view of the modular dwelling of FIG. 11.

In multifamily embodiments of the dwelling 10, the dwelling 10 or each tower 80 of the dwelling 10 can be divided into a plurality of units 82. Each story 70 of the dwelling 10 can be divided into multiple units 82 by separating walls 84. In FIG. 14, different units are shown by hatched lines running different directions. Each unit 82 may comprise interior walls that divide the unit 82 into multiple interior rooms such as bedrooms, bathrooms, a kitchen, or living room. A unit 82 may extend to one or more stories 70. A staircase 72 and/or an elevator 74 may be disposed external to the plurality of units 82 to allow inhabitants to access different units 82 on different stories 74 via a community staircase 72 or elevator 74.

Thus, although there have been described particular embodiments of the present invention of a new and useful modular dwelling, it is not intended that such references be construed as limitations upon the scope of this invention except as set forth in the following claims.

I claim:

1. A modular dwelling, comprising:

a foundation;

two or more intermodal containers disposed on and secured to the foundation, each intermodal container comprising a top, a bottom, a height extending vertically from the top to the bottom, a first side wall, a second side wall opposite the first side wall, a length extending horizontally from the first side wall to the second side wall and perpendicular to the height, a third side wall, a fourth side wall opposite the third side wall, a width extending horizontally from the third side wall to the fourth side wall and perpendicular to the height and length, and an open interior, wherein at least one of the first side wall, second side wall, third side wall, and fourth side wall of each intermodal container is a reinforced side wall having a substantially flat interior surface adjacent the open interior and a substantially flat exterior surface opposite the interior surface;

an interstitial space extending between and separating the intermodal containers; and a plurality of connector walls extending between the intermodal containers and at least partially enclosing the interstitial space;

a perimeter; and an exterior wall extending about the perimeter and integrally formed with the plurality of connector walls and at least two side walls of each intermodal container, the at least two side walls including the reinforced side wall of each intermodal container, wherein the height of each intermodal container is greater than the length and the width of each intermodal container, wherein the reinforced side wall of each intermodal container is substantially coplanar with the reinforced side wall of at least one other intermodal container.

2. The modular dwelling of claim 1, further comprising one or more openings in at least one side wall of each intermodal container, the one or more openings connecting the open interior of each intermodal container to the interstitial space.

3. The modular dwelling of claim 2, wherein the one or more openings cover greater than 75% of one side wall of at least one of the intermodal containers.

4. The modular dwelling of claim 1, further comprising one or more openings in two side walls of each intermodal container, the one or more openings connecting the open interior of each container to the interstitial space, wherein the two or more intermodal containers are four intermodal containers.

5. The modular dwelling of claim 1, further comprising a plurality of anchors embedded in the foundation, wherein each intermodal container is secured to at least one anchor.

6. The modular dwelling of claim 1, further comprising at least one of a doorway or window in the exterior wall.

7. The modular dwelling of claim 1, wherein the dwelling has a substantially rectangular horizontal plane profile.

8. The modular dwelling of claim 1, wherein the dwelling is divided into two or more stories.

9. The modular dwelling of claim 8, further comprising a staircase disposed within the dwelling and extending between the two or more stories.

10. The modular dwelling of claim 8, further comprising an elevator disposed within the dwelling and extending between the two or more stories.

11. The modular dwelling of claim 1, wherein each of the intermodal containers is electrically grounded.

12. The modular dwelling of claim 1, further comprising a roof disposed above the two or more intermodal containers and the interstitial space and a deck disposed on the roof.

13. A modular dwelling, comprising:

a foundation;

two or more intermodal containers disposed on and secured to the foundation, each intermodal container comprising a top, a bottom, a height extending vertically from the top to the bottom, a first side wall, a second side wall opposite the first side wall, a length extending horizontally from the first side wall to the second side wall and perpendicular to the height, a third side wall, a fourth side wall opposite the third side wall, a width extending horizontally from the third side wall to the fourth side and perpendicular to the height and length, and an open interior;

a perimeter; and an exterior wall extending about the perimeter and integrally formed with the plurality of connector walls and at least two side walls of each intermodal container, wherein the height of each intermodal container is greater than the length and the width of each intermodal container, wherein at least one of the first side wall, second side wall, third side wall, and fourth side wall of each intermodal container is a reinforced side wall having a substantially flat interior surface adjacent the open interior and a substantially flat exterior surface opposite the interior surface, wherein at least two of the reinforced side walls are substantially coplanar, wherein one of the at least two side walls of each intermodal container that are integrally formed with the exterior wall is the reinforced side wall of each intermodal container.

14. The modular dwelling of claim 13, further comprising:

a plurality of horizontal cross beams disposed adjacent the exterior surface of the reinforced side wall of each intermodal container;

a plurality of cavities formed by and disposed between the plurality of horizontal cross beams on each intermodal container; and insulation disposed within the plurality of cavities on each intermodal container.

15. The modular dwelling of claim 13, wherein the two or more intermodal containers are four intermodal containers, wherein the reinforced side walls of at least two of the intermodal containers are substantially coplanar, and wherein the reinforced side walls of at least one of the intermodal containers extends perpendicular to the reinforced side wall of at least one other intermodal container.

16. The modular dwelling of claim 13, wherein the one or more intermodal containers are four intermodal containers, and wherein the reinforced side wall of each intermodal container is substantially coplanar with the reinforced side wall of at least one other intermodal container.

17. The modular dwelling of claim 13, further comprising:

an exterior wall first side; and an exterior wall second side opposite the exterior wall first side, wherein the two or more intermodal containers are four intermodal containers, wherein the reinforced side walls of two intermodal containers are disposed adjacent the exterior wall first side and the reinforced side walls of the other two intermodal containers are disposed adjacent to the exterior wall second side.

18. A modular dwelling, comprising:

a foundation;

four intermodal containers disposed on the foundation, each intermodal container comprising a top, a bottom, a height extending vertically from the top to the bottom, a first side wall, a second side wall opposite the first side wall, a length extending horizontally from the first side wall to the second side wall and perpendicular to the height, a third side wall, a fourth side wall opposite the third side wall, a width extending horizontally from the third side wall to the fourth side wall and perpendicular to the height and length, and an open interior;

an interstitial space extending between and separating the intermodal containers; and a plurality of connector walls extending between the intermodal containers and at least partially enclosing the interstitial space between the intermodal containers;

a perimeter; and an exterior wall extending about the perimeter and integrally formed with the plurality of connector walls and at least two side walls of each intermodal container, wherein the height of each intermodal container is greater than the length and the width of each intermodal container, wherein at least one of the first side wall, second side wall, third side wall, and fourth side wall of each intermodal container is a reinforced side wall, having a substantially flat interior surface adjacent the open interior and a substantially flat exterior surface opposite the interior surface, wherein the first side walls of at least two of the intermodal containers are substantially coplanar, wherein one of the at least two side walls of each intermodal container that are integrally formed with the exterior wall is the reinforced side wall of each intermodal container.

* * * * *